US006206596B1

(12) United States Patent
Johnson

(10) Patent No.: US 6,206,596 B1
(45) Date of Patent: Mar. 27, 2001

(54) WASHCLOTH WITH POCKET

(75) Inventor: Christopher Johnson, Diamond Bar, CA (US)

(73) Assignee: Johnson Family Trust, Orville L. and Delories M. Johnson, Trustees, a Family Trust, Diamond Bar, CA (US)

( * ) Notice: Subject to any disclaimer, the term of this patent is extended or adjusted under 35 U.S.C. 154(b) by 0 days.

(21) Appl. No.: 09/374,123

(22) Filed: Aug. 12, 1999

(51) Int. Cl.[7] ..... A46B 5/02
(52) U.S. Cl. ..... 401/6; 401/7; 401/201
(58) Field of Search ..... 401/6, 7, 201, 401/196, 88

(56) References Cited

U.S. PATENT DOCUMENTS 674,913 * 5/1901 Fike ..... 401/7
1,351,311 * 8/1920 Virneburg ..... 401/201
2,279,100 * 4/1942 Worth et al. ..... 401/7
2,668,309 * 2/1954 Colgan ..... 401/201
3,581,447 * 6/1971 Falivene ..... 401/201
4,665,580 * 5/1987 Morris ..... 401/201

* cited by examiner

*Primary Examiner*—David J. Walczak
(74) *Attorney, Agent, or Firm*—Kajane McManus

(57) ABSTRACT

The washcloth includes a pocket which is positioned on one surface of the washcloth and includes a neck through which a bar of soap can pass only in a lengthwise direction. The neck leads to an expanded cavity within which the bar of soap is engaged when rotated out of alignment with the neck. Further, the washcloth is layered and may serve as a wash mit, accommodating right and left hand use.

1 Claim, 3 Drawing Sheets

FIG. 1
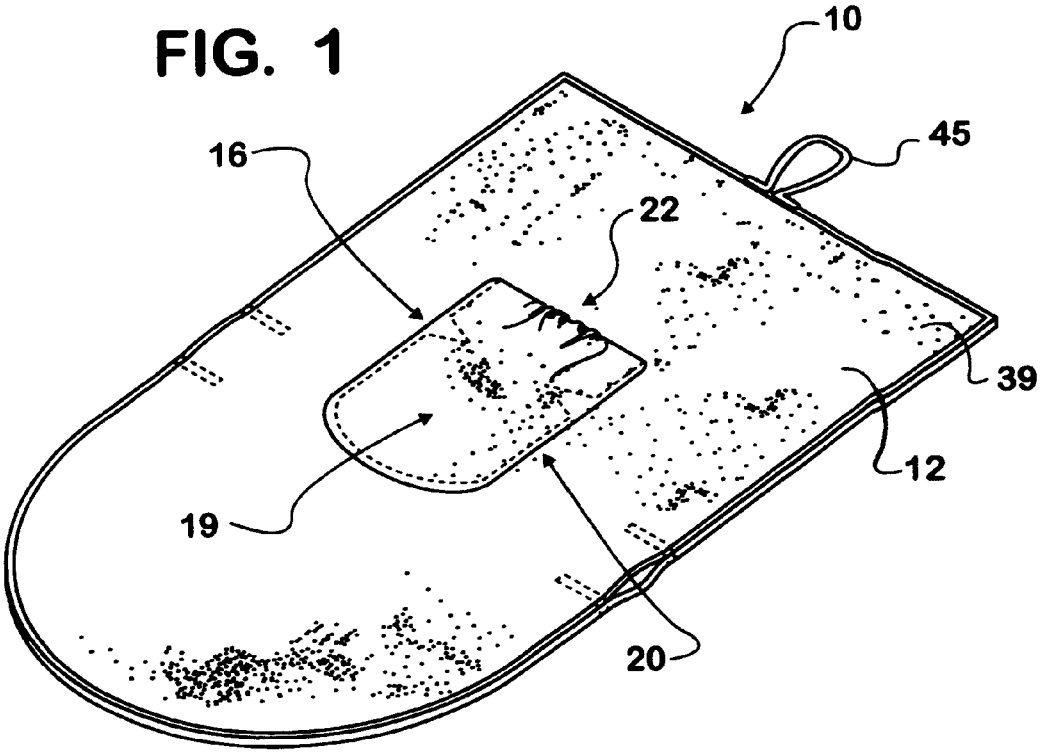
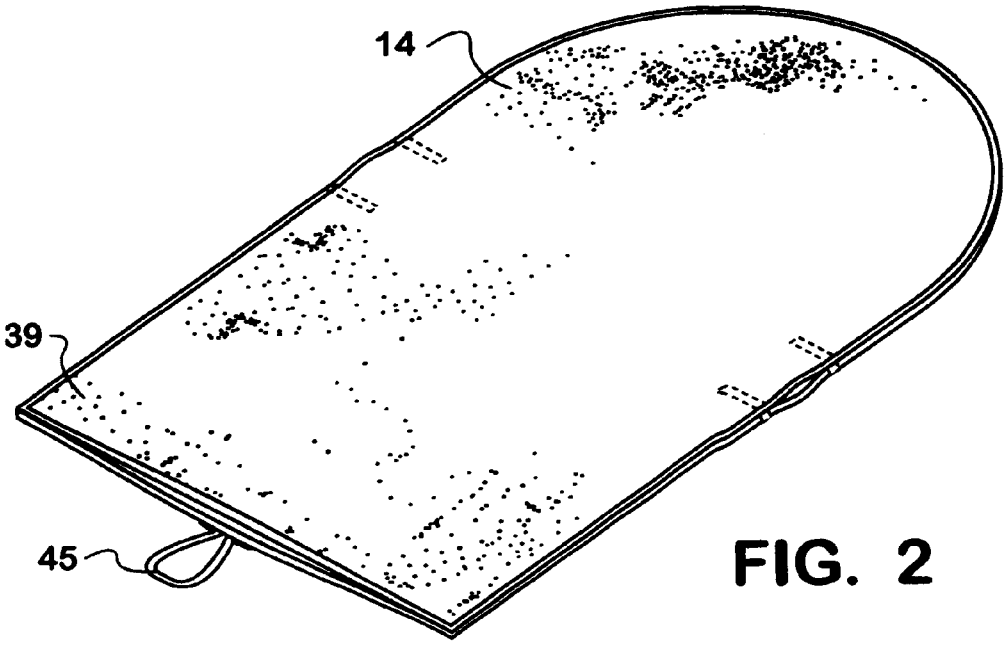
FIG. 2

FIG. 3
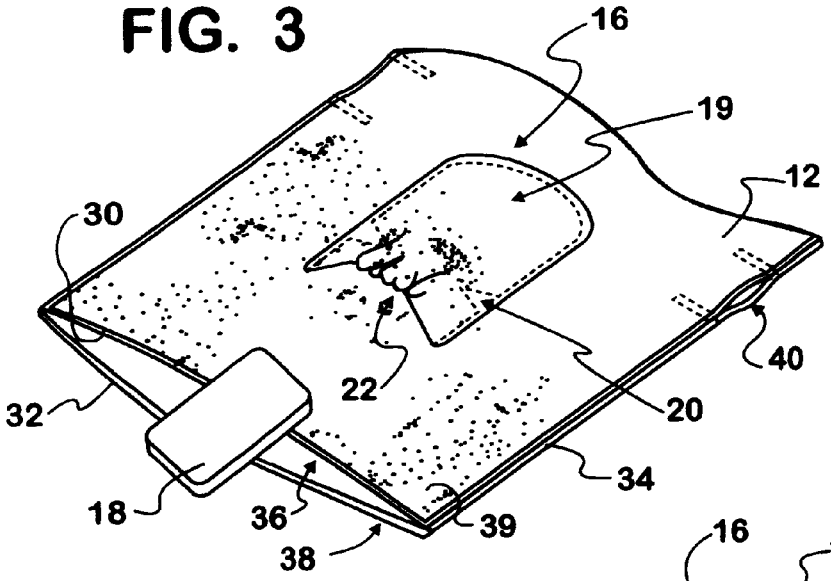
FIG. 4
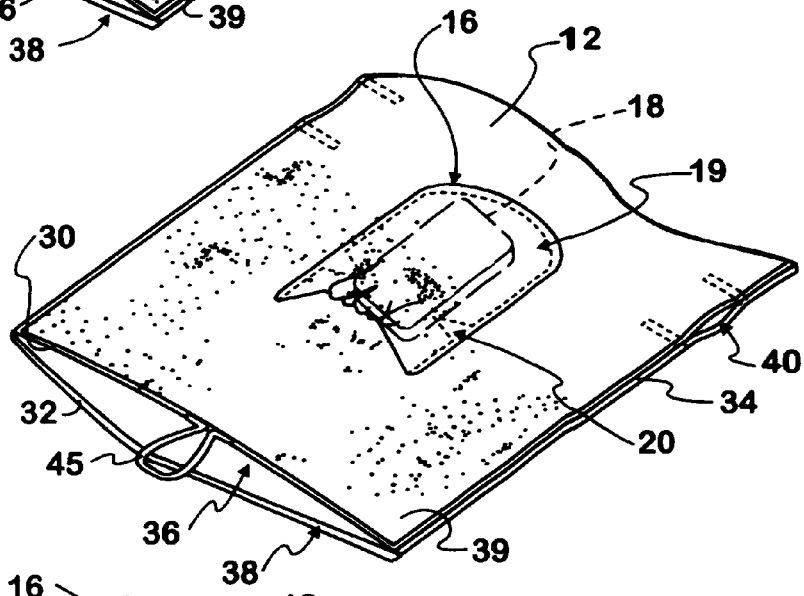
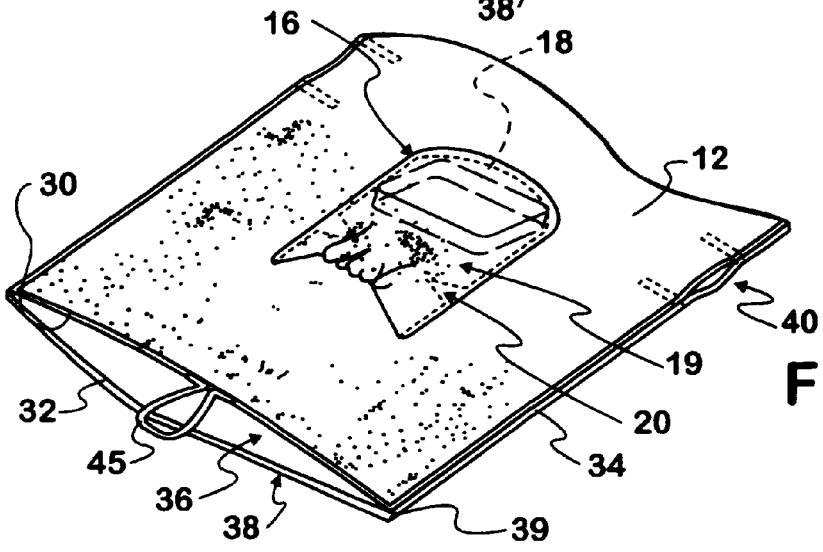
FIG. 5

WASHCLOTH WITH POCKET

BACKGROUND OF THE INVENTION

1. Field of the Invention

The present invention relates to a washcloth incorporating a pocket within which a bar of soap may be engaged. Further, the washcloth may, if desired, be used as a wash mit, accommodating both right and left hand use.

2. Prior Art

Heretofore, various washcloth type structures incorporating various embodiments of pockets for engaging a bar of soap therein have been proposed.

Further, stand alone pocket structures for holding soap and pieces thereof together for use have also been proposed. However, as will be described in greater detail hereinafter, it is not believed that a washcloth which also may be used as a wash mit for either hand and which includes a soap engaging pocket configured as disclosed herein has ever been proposed.

SUMMARY OF THE INVENTION

According to the invention there is provided a washcloth with a pocket, the pocket being positioned on one surface of the washcloth and including a neck which will accommodate passage of a bar of soap therethrough only in a lengthwise direction, the neck leading to an expanded cavity within which the bar of soap is engaged when rotated out of alignment with the neck. Further, the washcloth may serve as a wash mit, accommodating right and left hand use.

BRIEF DESCRIPTION OF THE DRAWINGS

FIG. 1 is a perspective view of a front or top surface of the washcloth with pocket.

FIG. 2 is a perspective view of a rear or bottom surface of the washcloth with pocket.

FIG. 3 is a perspective view of a portion of the washcloth including the pocket and shows a bar of soap about to be engaged in the pocket.

FIG. 4 is a perspective view similar to FIG. 3 but shows the bar of soap being slid into the pocket lengthwise through a neck thereof.

FIG. 5 is a perspective view similar to FIG. 4 but shows the bar of soap being rotated into an expanded cavity comprising the pocket and out of alignment with the neck.

DESCRIPTION OF THE PREFERRED EMBODIMENT

Figure 6:
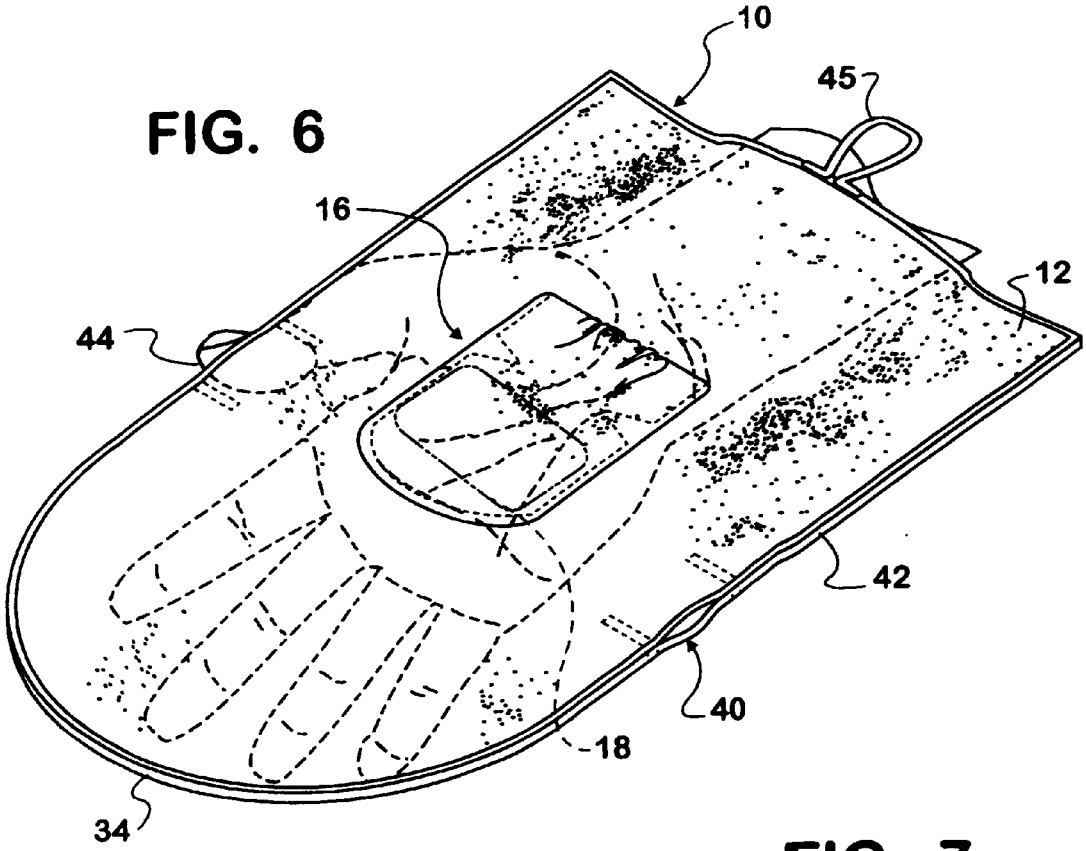
FIG. 6 is a perspective view of the washcloth showing same to be of two layers capable of forming a wash mit and showing a hand in phantom therein, the thumb of which extends through one of two lateral thumb slots in the washcloth.
Figure 7:
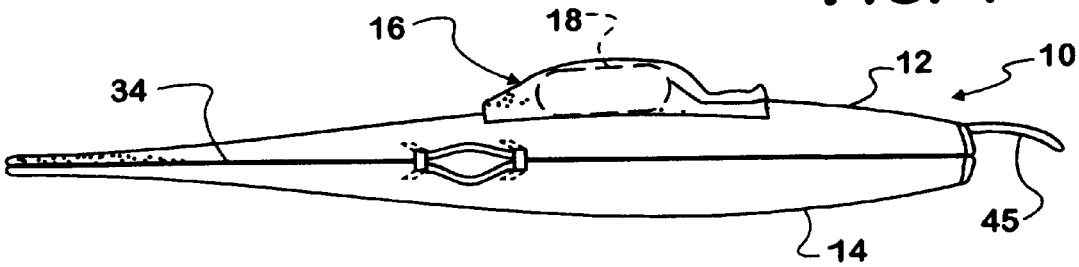
FIG. 7 is a side view of the washcloth showing a bar of soap engaged in the pocket thereof.
Figure 8:
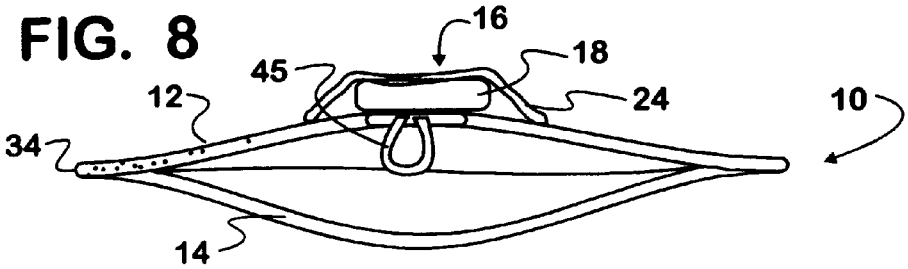
FIG. 8 is an end view of the washcloth and showing a bar of soap engaged in the pocket thereof.

Referring now to the drawings in greater detail there is illustrated in the Figures a washcloth with pocket made in accordance with the teachings of the present invention and generally identified by the reference numeral 10.

The washcloth 10 is a substantially planar structure having a top or front surface 12 and a bottom or rear surface 14. A pocket 16 is provided on the top surface 12 within which a bar of soap 18 is received. The pocket 16 comprises an expanded cavity 19, access to which is attained through a neck 20 which is fixed and configured to allow the bar of soap 18 to pass therethrough only in a lengthwise manner, with the bar of soap 18 being turned out of alignment with the neck 20 lying crosswise relative to the neck 20 within the cavity 16 which is perpendicular to the neck 20.

If desired, an entry end 22 of the neck 20 of the pocket 16 may be provided with an elastic band 24 as an additional means of assuring securement of the bar of soap 18 therein.

Turning back now to the washcloth 10, it will be seen to comprise a substantially planar structure 10, preferably made of a soft cloth like material, which may be of two layers 30 and 32, the layers 30 and 32 being engaged to each other along a substantial portion of a periphery 34 thereof, producing a hollow 36 therebetween into which a hand (shown in phantom) of a user may be slid through an opening 38 at one end 39 of washcloth 10, defining a substantially mit like washcloth 10.

From the view portraying the hand, it will be seen that the pocket 16 is positioned to preferably overlie a palm of the hand when the hand is inserted into the hollow 36.

To allow for an improved grip on the washcloth 10, by either hand of the user, a thumb slit 40 is provided along each lateral edge 42 of the washcloth 10, through one of a which a thumb 44 of a right hand may be extended and though the order of which a thumb of a left hand may be logically extended so as to maintain the pocket 16 overlying the palm of the hand being used.

Still further, if desired, a handing loop 45 may be provided at any suitable position along the periphery 34 of the washcloth 10, allowing for ease in hanging the washcloth 10 to allow for drying thereof.

Yet further, although not shown, nothing would preclude one from providing an elastic strap about the opening 38 through which the hand of the user is inserted into the hollow 36.

As described above, the washcloth 10 provides a number of advantages, some of which have been described above and other of which are inherent in the invention. Also modifications may be proposed to the washcloth 10 without departing from the teachings herein. For example, the washcloth 10 may be configured to portray an easily definable item such as a football, etc., without extending outside the scope of the invention.

Accordingly, the scope of the invention should only be limited as necessitated by the accompanying claims.

I claim:

1. A washcloth with a pocket, the pocket being positioned on one surface of the washcloth and including a neck which will accommodate passage of a bar of soap therethrough only in a lengthwise direction, the neck leading to an expanded cavity within which the bar of soap is engaged when rotated out of alignment with the neck, the washcloth being made of two layers of material engaged together to define a mitt including two lateral edges, each lateral edge including a slit therein for receiving a thumb of a user therethrough.

* * * * *